US011724170B2

(12) United States Patent
Hannallah et al.

(10) Patent No.: US 11,724,170 B2
(45) Date of Patent: Aug. 15, 2023

(54) SQUASH BALL LAUNCHING MACHINE

(71) Applicant: Stingray Squash Machines Limited, Guildford (GB)

(72) Inventors: Anthony Paul Nashaat Hannallah, Guildford (GB); Jonathan Paul Taylor, Stonehouse (GB)

(73) Assignee: Stingray Squash Machines Limited, Guildford (GB)

( * ) Notice: Subject to any disclaimer, the term of this patent is extended or adjusted under 35 U.S.C. 154(b) by 164 days.

(21) Appl. No.: 17/319,037

(22) Filed: May 12, 2021

(65) Prior Publication Data

US 2021/0354021 A1 Nov. 18, 2021

Related U.S. Application Data

(60) Provisional application No. 63/024,276, filed on May 13, 2020.

(51) Int. Cl.
*A63B 69/40* (2006.01)
*A63B 47/00* (2006.01)
(Continued)

(52) U.S. Cl.
CPC ..... *A63B 69/406* (2013.01); *A63B 47/005* (2013.01); *A63B 71/0622* (2013.01);
(Continued)

(58) Field of Classification Search
CPC . A63B 69/406; A63B 47/005; A63B 71/0622; A63B 47/02; A63B 2071/0683;
(Continued)

(56) References Cited

U.S. PATENT DOCUMENTS 4,632,088 A 12/1986 Bruce
5,464,208 A 11/1995 Pierce
(Continued)

FOREIGN PATENT DOCUMENTS

DE 3151886 A1 7/1983
GB 2095565 A 10/1982
(Continued)

OTHER PUBLICATIONS

The International Search Report and Written Opinion rendered by the International Searching Authority for PCT/EP2021/062715, dated Oct. 18, 2021, 17 pages.

*Primary Examiner* — Jeffrey S Vanderveen
(74) *Attorney, Agent, or Firm* — Skaar Ulbrich Macari, P.A.

(57) ABSTRACT

An automatic ball launcher includes a ball feed control system that includes a meter wheel with radially-spaced ribs or grooves to selectively block and pass balls to the fly-wheels of the launcher. The meter wheel rotates to selectively block and release a single ball to pass at a time. The controller of the launcher can be programmed to stop the meter wheel when a ball has been metered by monitoring the current at peak of the motor driving the meter wheel. A meter-event can be determined to have occurred when the current of the drive motor drops to a trough by a pre-set magnitude following a rise to a peak value. A remote control can be provided for the user to operate the launching machine and adjust a plurality of parameters.

20 Claims, 13 Drawing Sheets

(51) Int. Cl.

| | |
|---|---|
| ***A63B 71/06*** | (2006.01) |
| ***A63B 102/06*** | (2015.01) |
| ***A63B 47/02*** | (2006.01) |

(52) U.S. Cl.
CPC ..... *A63B 47/02* (2013.01); *A63B 2071/0683* (2013.01); *A63B 2102/06* (2015.10); *A63B 2220/72* (2013.01); *A63B 2220/833* (2013.01); *A63B 2225/093* (2013.01); *A63B 2225/50* (2013.01); *A63B 2225/64* (2013.01)

(58) Field of Classification Search
CPC ..... A63B 2102/06; A63B 2220/72; A63B 2220/833; A63B 2225/093; A63B 2225/50; A63B 2225/64; A63B 71/023; A63B 2071/0625; A63B 2220/13; A63B 2220/24; A63B 2220/62; A63B 2220/64; A63B 2225/305; A63B 47/002; A63B 2047/004; A63B 2209/00; A63B 2210/50; A63B 2220/805; A63B 2225/02; A63B 2225/09
See application file for complete search history.

(56) References Cited

U.S. PATENT DOCUMENTS

| | | | | |
|---|---|---|---|---|
| 5,897,445 | A * | 4/1999 | Sanders | A63B 24/0003 473/421 |
| 7,093,591 | B1 | 8/2006 | Baxter | |
| 10,898,781 | B2 * | 1/2021 | Qian | A63B 69/406 |
| 2002/0155907 | A1 * | 10/2002 | Bewley | A63B 69/40 473/451 |
| 2006/0118096 | A1 | 6/2006 | Cucjen et al. | |
| 2008/0032828 | A1 | 2/2008 | Alger | |
| 2009/0095273 | A1 * | 4/2009 | Paulson | A63B 69/0002 124/78 |
| 2009/0227401 | A1 | 9/2009 | Mauer et al. | |
| 2013/0104869 | A1 | 5/2013 | Lewis et al. | |
| 2014/0261363 | A1 | 9/2014 | Lu | |
| 2016/0193520 | A1 * | 7/2016 | Hart | A63B 69/406 124/78 |
| 2019/0176008 | A1 | 6/2019 | Antelme et al. | |

FOREIGN PATENT DOCUMENTS

| | | | |
|---|---|---|---|
| JP | H08503390 | A * | 4/1996 |
| WO | 2005044390 | A2 | 5/2005 |

* cited by examiner

SQUASH BALL LAUNCHING MACHINE

PRIORITY

This application claims the priority benefit of U.S. Provisional Application No. 63/024,276, filed on May 13, 2020, which is hereby incorporated herein by reference in its entirety.

FIELD

The present invention relates generally to automatic sporting projectile and ball feeders, and more particularly, to automatic feeders with the ability to precisely control the discharge of squash balls into the flywheels.

BACKGROUND

Automatic ball launchers are known. Typical ball launchers employ one or more counter-rotating flywheels that launch the ball when the ball comes in contact with the outer surface of the flywheel. Such ball launchers can be configured for launching a variety of projectiles, such as balls used in squash, tennis, cricket, baseball, softball, American football, football, volleyball, pickle ball, etc., and non-spherical projectiles such as shuttlecocks used in badminton.

Conventional squash ball launchers are designed for group use (e.g., club, team, coach). The basic components are a hopper, a heater and the shooter mechanism. Such hoppers can have a capacity of up to 80-100 balls. The heater is provided because tournament grade squash balls must be warmed up to a surface temperature of approximately 44 degrees Celsius to bounce properly. In match play, the ball is warmed sufficiently by being struck. But in a hopper with an 80-ball capacity, no ball is struck often enough to become warmed up sufficiently. Thus, the heater is provided.

A significant drawback to the conventional squash ball launchers described above is that the weight, size and complexity of the apparatus makes it impractical for an individual to own and use. Moreover, the portability of such machines is poor and the cost is relatively high. Therefore, conventional squash ball launchers are typically owned by groups such as teams or clubs, are used by more than one person, and are stored court-side.

Another drawback to the conventional devices is that the overall height of existing squash ball launchers, and their fixed firing height, bulk and limited range of firing angles all severely limit the variety of possible shot simulations. For example, it is not currently possible for a single launching machine placed in front of the user to provide high looped shots from the front of the court and shots played from high to low.

A further drawback of conventional launching machines is the inability to precisely control the discharge timing of squash balls to the flywheels, resulting in misfires, jams and/or double-fires.

Therefore, there is a continuing need to provide an improved ball launching machine that overcomes at least some of the deficiencies of prior art devices as completely as possible.

SUMMARY

Provided is a projectile launcher that is particularly well suited to automatically feed and launch squash balls by precisely controlling the discharge of squash balls in to the flywheel. Note that the present invention can further apply to a launching device for any other ball or rounded sports projectile configuration.

In one example launcher machine, the balls are staged in a tubular collector. The balls are heated within the collector to a desired temperature. The collector is inserted into the top of a base unit that contains the flywheels for launching the heated balls one at a time. The base unit is sufficiently small that it can be mounted on a tri-pod, which increases the range of shots that can be simulated. The ball launching system is also conveniently lightweight, so it is portable and well suited for use by an individual, yet powerful enough to replicate the ball velocities provided by top of the line conventional ball launching machines.

The foregoing launcher device, or other configuration of launcher device, can be configured to include a ball feed control system that includes a meter wheel with radially-spaced ribs or grooves to selectively block and pass balls to the flywheels of the launcher. The meter wheel rotates to selectively block and release a single ball to pass at a time. The controller of the launcher can be programmed to stop the meter wheel when a ball has been metered by monitoring the peak current draw of the motor driving the meter wheel. A meter-event can be determined to have occurred when the current of the drive motor drops to a trough by a pre-set magnitude following a rise to a peak value. Movement of the meter wheel is stopped when a ball passes so that a second ball does not inadvertently also pass and jam the launcher.

The launcher device can be controlled by a computer processor or controller. The controller of the launcher device can be programmed to determine that a ball has been metered by monitoring the electrical current peak value of the motor driving the meter wheel occurring when compressing the squash ball to the current trough value for the motor occurring after the ball has exited the meter wheel to indicate a metered event. The meter wheel's motor can be stopped after the trough value has been detected.

A remote control can be provided for the user to operate the launching machine and adjust a plurality of parameters.

In one disclosed example, an automatic ball launcher includes a base unit and a feed tube coupled to the base unit. The base unit includes an enclosure defining a forward opening where the balls eject and a top opening for receiving the feed tube. A pair of counter-rotating flywheels are disposed in a common plane and located inside of the enclosure. The feed tube includes an elongated tubular body with an open top end covered by a removable cap and an open bottom end configured to be securely inserted into the top opening of the enclosure. The feed tube can include a heating element to heat the balls to a desired temperature prior to launch. The feed tube can be used to collect balls from the ground without the user needing to bend over.

A plurality of adjustable front feet can be provided to the enclosure that telescope vertically downwards from a bottom surface of the enclosure. A vertically extending stand or tripod can also be secured to the enclosure so that the base unit is maintained in an elevated position.

The pair of counter-rotating flywheels each can comprise a rubber material located such that the ball is contacted by the rubber material during a launching event.

The common plane can be a horizontal plane, a vertical plane, and can be an oblique angle with respect to the horizontal plane. The orientation angle of the common plane can also be adjustable.

The pair of counter-rotating flywheels can be mounted atop a frame that is disposed within the enclosure. At least one flywheel of the pair of counter-rotating flywheels can be disposed in an adjustable track so that a spacing distance defined between the pair of flywheels is adjustable.

The base unit can further include a ball speed adjustment selector.

The feed tube can further include a heating element provided to the tubular body or it can be embedded within the tubular body. Insulation can be provided to the exterior surface of the tubular body. The heating element can be a resistive heating element. A temperature sensor can be disposed within the feed tube.

The feed tube can further comprise a solenoid provided to the open bottom end to prevent balls from prematurely exiting through the bottom end.

In another disclosed example a method of preparing and launching squash balls can include storing a plurality of squash balls inside of a feed tube while the feed tube is coupled to a launching base unit, heating the plurality of squash balls stored inside of the feed tube with heating elements disposed in the feed tube until the squash balls reach a desired temperature, and launching the heated squash balls with the launching base unit one at a time while maintaining the desired temperature of the heated squash balls in the feed tube that have not yet been launched.

The feed tube can be removed from the launching base unit and used to retrieve the squash balls by centering the lower opening over a ball and pushing the feed tube downwards towards the squash ball until the squash ball slips inside of the feed tube.

A launch angle of the launching base unit can be adjusted by extending one or more feet downwards from a bottom side of the launching base unit, or by providing an adjustable head between the tripod or stand and the launcher. A vertical height of the launching base unit can be adjusted by mounting the launching base unit atop a tripod or a stand. The height of the tripod or stand can be adjustable.

In an example embodiment, a ball launching machine can comprise a base unit comprising an enclosure, a pair of counter-rotating flywheels disposed within the enclosure, and a meter wheel disposed within the enclosure. The meter wheel can be located adjacent to an inlet to the pair of counter-rotating flywheels such that the meter wheel can selectively pass the balls to the pair of counter-rotating flywheels via rotation of the meter wheel. A rotational axis of the meter wheel can be oriented perpendicular to a rotational axis of the pair of counter-rotating flywheels.

The meter wheel can comprise a textured circumferential outer surface.

A feed tube can be coupled to the base unit. The feed tube can comprise an elongated tubular body with an open top end covered by a removable cap and an open bottom end configured to be securely inserted into a top opening defined in the enclosure. The feed tube can comprise a heating element and/or a temperature sensor disposed within the feed tube. The heating element and/or temperature sensor can be embedded in a sidewall of the feed tube. The feed tube can further comprise a solenoid provided to the open bottom end to prevent balls from prematurely exiting through the bottom end.

A plurality of adjustable front feet can be provided to the enclosure that extend vertically downwards from a bottom surface of the enclosure. A vertically extending stand or tripod can be secured to the enclosure so that the base unit is maintained in an elevated position. A multi-directional and motorized head can also be coupled to the base unit. The multi-directional and motorized head can include an elevation motor configured to automatically adjust an elevation of the base unit and an azimuth motor configured to adjust an azimuth orientation of the base unit.

A wireless remote control for the ball launching machine can be provided. The wireless remote control can comprise a plurality of buttons, a first visual display indicating a speed setting for launching of the balls and a second visual display indicating a time interval for launching the balls.

A drive motor can be coupled to the meter wheel and a controller can be electrically coupled to the drive motor. The controller can be configured to selectively actuate the drive motor to turn the meter wheel. The controller can be configured to determine that one of the balls has been metered by monitoring a load value of the drive motor. For example, a meter-event can be determined to have occurred when the current being monitored for the drive motor drops to a trough following a rise to a peak value by a pre-set magnitude value. The controller can be configured to stop the drive motor from rotating the meter wheel following the determination that one of the balls has been metered.

Also disclosed is a method of staging balls to be launched with an automatic ball launching device. The method in one example can comprise providing a metering wheel to stage balls to be launched by a pair of counter-rotating flywheels, monitoring a current of a drive motor coupled to the metering wheel, and determining by the automatic ball launching device that one of the balls has been metered when the current of the drive motor drops to a trough by a pre-set magnitude following a rise to a peak value. The drive motor can be stopped from rotating the meter wheel following the determination that one of the balls has been metered.

The disclosure also includes a ball metering system for an automatic ball launching device. The ball metering system in one example can comprise a drive motor and a meter wheel coupled to the drive motor. The meter wheel can be located adjacent to an inlet to a pair of counter-rotating flywheels such that the meter wheel can selectively pass the balls to the pair of counter-rotating flywheels via rotation of the meter wheel. A rotational axis of the meter wheel can be oriented perpendicular to a rotational axis of the pair of counter-rotating flywheels.

The ball metering system can include a controller electrically coupled to the drive motor. The controller can be configured to selectively actuate the drive motor to turn the meter wheel. The controller can be configured to determine that a ball has been launched by the counter-rotating flywheels when a current being monitored for the flywheel drive motors drops to a trough following a rise to a peak value by a pre-set magnitude value. The controller can also be configured to stop the drive motor from rotating the meter wheel following the determination that one of the balls has been metered.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
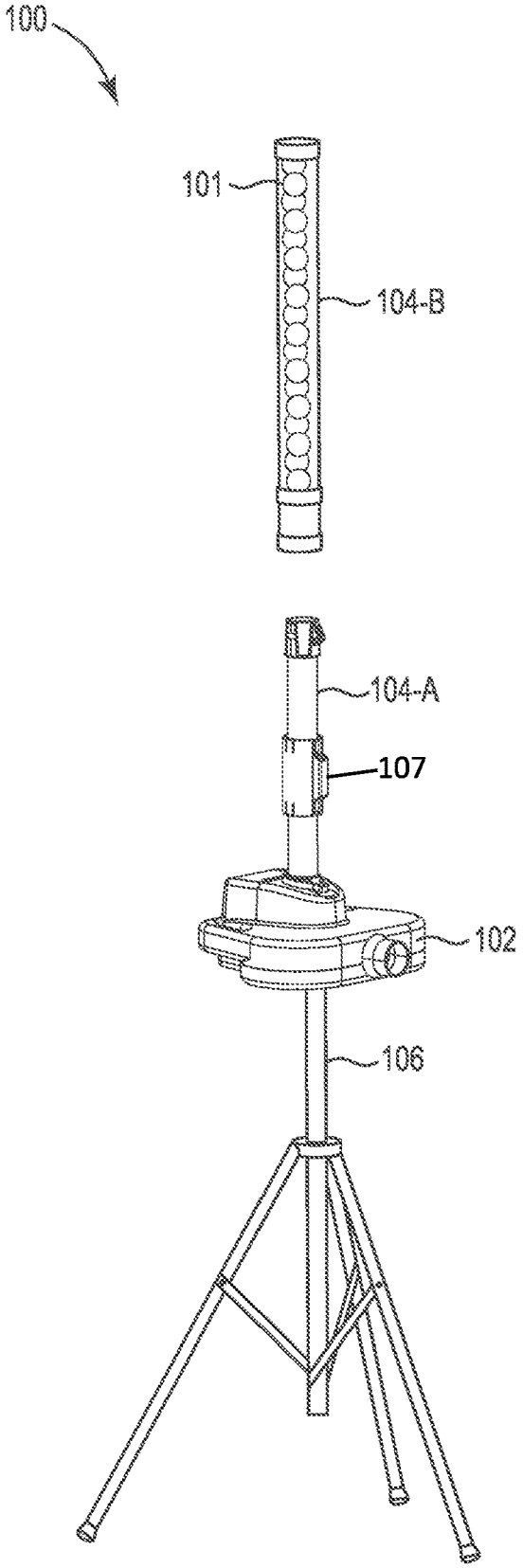
FIG. 1 is a perspective view of an automatic ball launching system in accordance with an embodiment of the invention.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention.

Referring generally to FIGS. 1-15, an automatic ball launcher 100 includes a launching base unit 102, a vertical feed tube 104A or 104B coupled to the base unit 102 and an optional stand 106. The stand 106 can be a tripod, such as shown, or other raised platform. This allows for a wide variety of shot simulations to be performed.

Note that a plurality of balls 101, such as squash balls, are shown inside of feed tube 104B. Of course, the invention can be adapted or adjusted to launch other types of balls.

Two different types of feed tubes 104A, 104B are shown. A basic feed tube 104A is a simple hollow cylindrical tube through which the squash balls are inserted and held while being fed into the base unit 102. The other feed tube configuration 104B includes heating elements to heat the squash balls 101 located within the tube 104B, if desired. The feed tube will be generally designated as 104 hereinafter.

The feed tube 104 is removable from the base unit 102 so that it can be used to collect balls 101 and hold those balls in a ready condition for introduction to the base unit 102.

Figure 2:
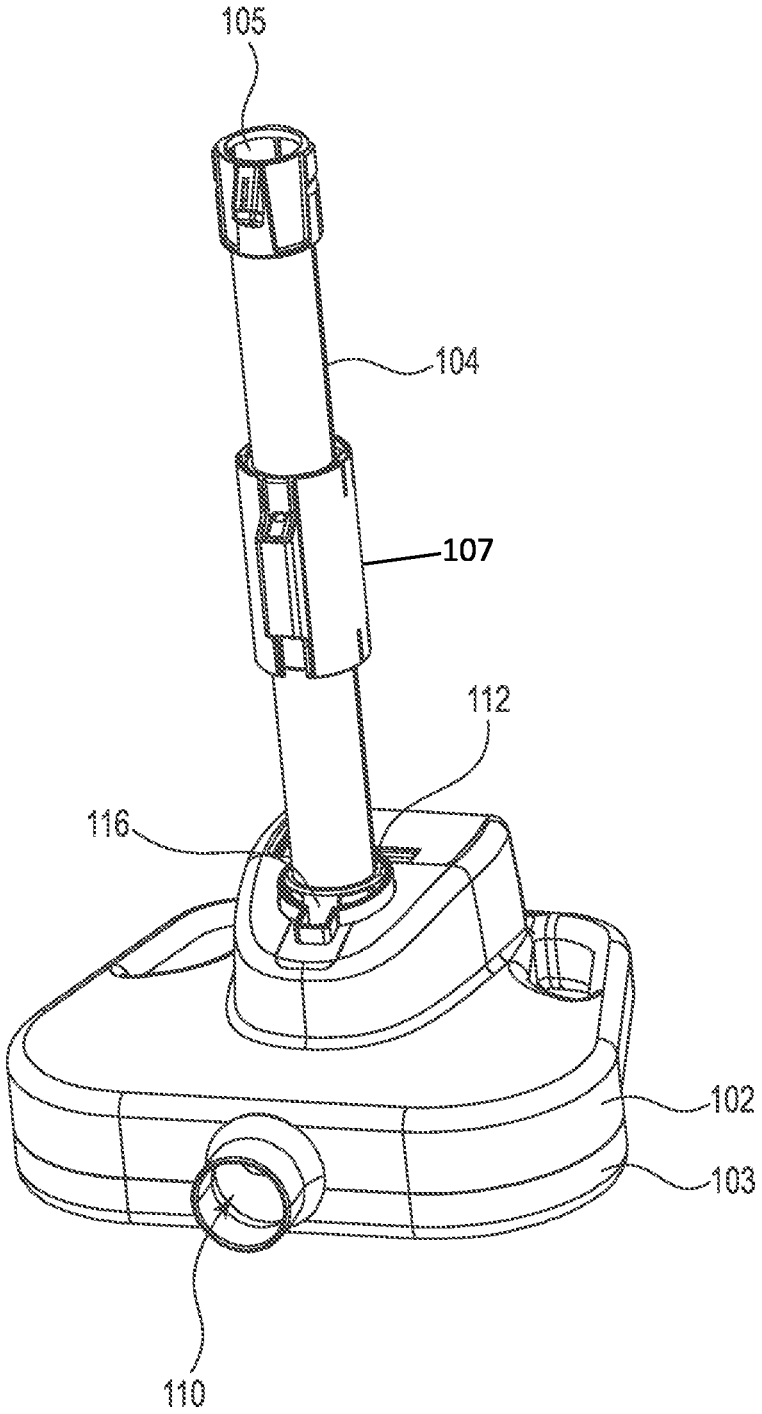
FIG. 2 is another perspective view of an automatic ball launching system in accordance with an embodiment of the invention.

The feed tube 104B in FIGS. 1 and 104 in FIG. 2 includes a joiner 107 that can be used to join together two feed tubes to form a longer tube to hold more balls.

Figure 3:
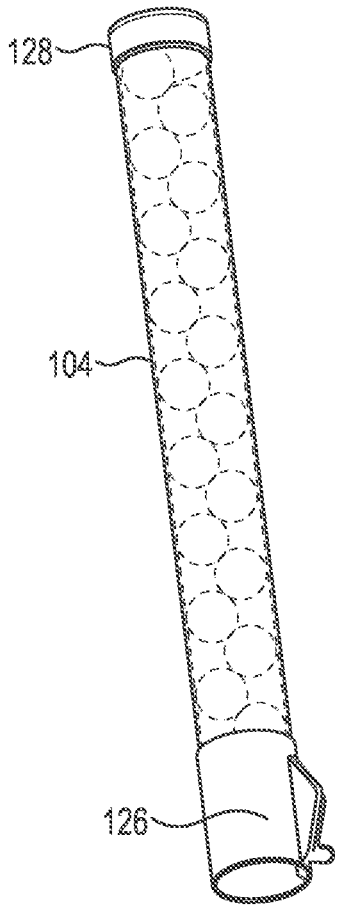
FIG. 3 is a perspective view of a feed tube for an automatic ball launching system in accordance with an embodiment of the invention.

Referring to FIG. 3, the tube 104 defines a cylindrical or tubular body with a bottom end having a lower collection opening 126 and an open top end covered by a cap 128 and a hollow interior space between the bottom end and top end. The cap 128 keeps the balls 101 from overflowing out the top of the tubular body 104. The lower collection opening 126 defines an orifice that acts as a pinch point so that a resisting force must be overcome to allow a ball to pass. Thus, the balls do not fall out the bottom end of the tube 104. The orifice can be a spring-actuated lever or other means for creating an interference with the balls exiting the lower opening 126. A second cap can be used to cover the lower collection opening 126. The second cap can be the same configuration as the top cap 128, or it can be a different configuration.

In use, the user pushes the bottom end of the tube 104 downwards over a ball 101 on the ground so that the ball pushes past the orifice and enters the tube's interior. Thus, the ball 101 is retained inside of the tube 104. Subsequent balls are pushed upwards towards the top cap 128 by the same process until the tube is filled completely to the cap 128. Thus, balls 101 can be retrieved without the need of the user to bend over.

Referring additionally to FIG. 2, the user can insert the lower collection opening 126 of the tube 104 into the feed opening 112 in the top of the base unit 102. There is structure inside of the orifice 112 to selectively retract the lever that forms the orifice so that the balls can be fed one-at-a-time into the inlet of the flywheels (114 in FIGS. 4-5).

Figure 4:
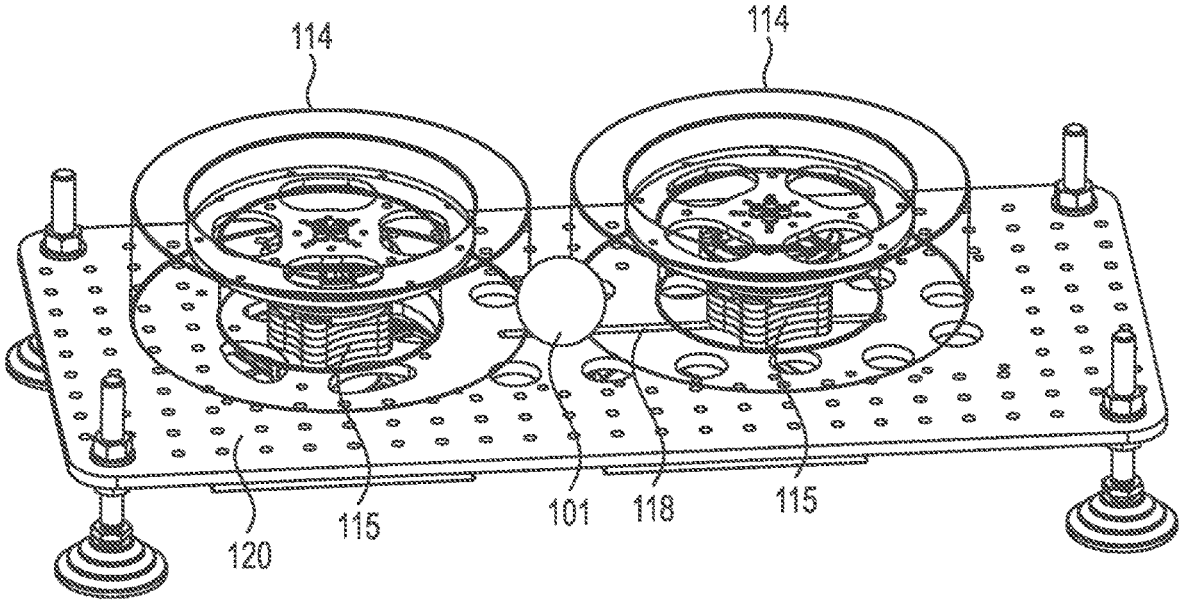
FIG. 4 is a perspective view of the frame and flywheels sub-assembly of an automatic ball launching system in accordance with an embodiment of the invention.

The base unit 102 includes an enclosure 103 with an opening 110 defined in the forward or front side where the balls eject from the launcher device 100, and a feed opening 112 in the top side where the feed tube 104 protrudes above the enclosure 103. The balls 101 are staged into the open top 105 of the feed tube 104 to form a column of several balls that wait to be launched, one at a time, from the launcher 100. The opposing bottom end of the feed tube 104 is disposed into the feed opening 112 and presents balls 101 to an inlet located between the side-by-side flywheels 114 as shown in FIG. 4. A solenoid or other ball metering means is employed to hold back the ball to be launched until the proper timing setting is satisfied or until triggered by the user. Once a ball is released by the metering means, the subsequent ball is held back by the metering means so that a jam does not occur.

Figure 5:
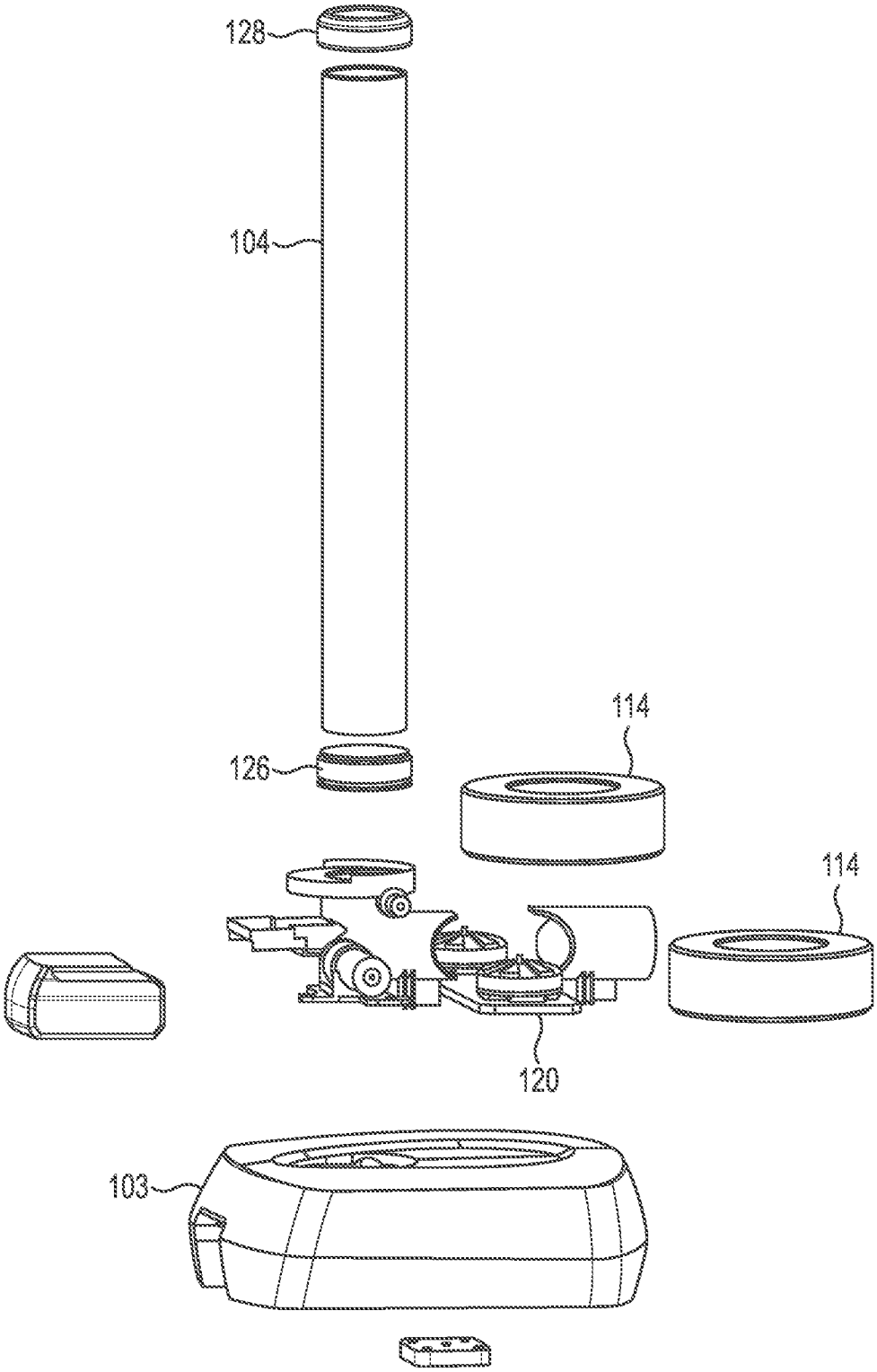
FIG. 5 is an exploded perspective view of an automatic ball launching system in accordance with an embodiment of the invention.

Referring to FIGS. 4-5, a pair of electric motors 115 are provided such that each turns a respective one of the pair of flywheels 114 at a sufficient rotational speed (in opposite directions) to impart a desired initial launch velocity of the ball 101. The initial launch velocity can be set by the user with a dial 116 (shown in FIG. 2) or other input means on the base unit 102. The motors 115 can be powered by electricity supplied by a cord, onboard batteries or other suitable power source. A single motor can also be used in an alternative embodiment where the motor is coupled to each of the flywheels 114.

The flywheels 114 shown in FIGS. 4-5 are disposed in a horizontal orientation in a common plane. However, the flywheels 114 can also be disposed in a vertical plane or at any other plane angle between the vertical and horizontal planes.

By varying plane angle and the relative speed of the counter-rotating flywheels 114, a variety of spins can be imparted to the ball 101 being launched.

The horizontal spacing of the flywheels 114 can be adjusted via a track 118 defined in the frame 120 to which the flywheels 114 are mounted. This feature allows the base unit 102 to accommodate a wide range of ball diameters and types. The feed tube 104 may also be switched to a tube with a larger inner diameter, if necessary, to accommodate the outer diameter of the balls being fed.

The flywheels 114 can also be changed to provide different circumferential surface types and textures adapted for different types of balls. For example, the outer circumferential surfaces can be a firm rubber, soft rubber, metal, plastic, knurled, smooth, etc.

Figure 6:
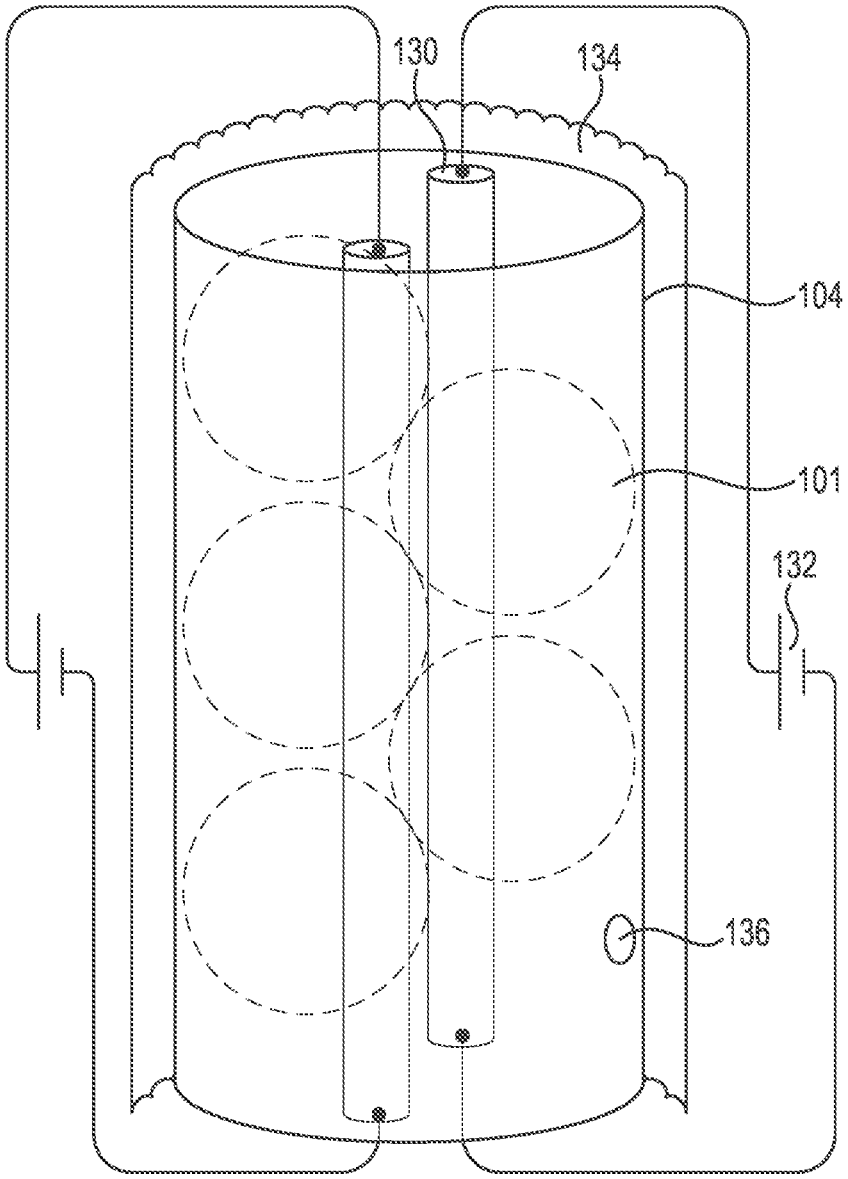
FIG. 6 is a perspective view diagram of a heated ball collector of an automatic ball launching system in accordance with certain embodiments of the invention.
Figure 7:
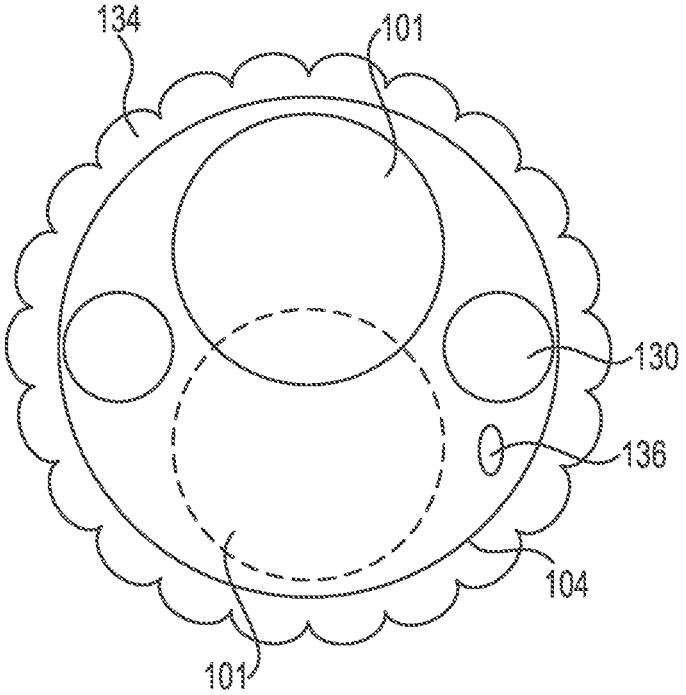
FIG. 7 is a top view diagram of a heated ball collector of an automatic ball launching system in accordance with certain embodiments of the invention.

Referring now to FIGS. 6-7, the balls 101 in the tube 104 can be heated via a plurality of heating elements 130 disposed within the body of the tube 104. The heating elements 130 can be longitudinally-extending resistive heating rods as shown in the figures, or they can take another form that still allows the balls to be collected. The heating elements 130 can also be molded or formed into the tubular body 104 itself. For example, resistive heating wires can extend longitudinally through the sidewall of the tube body. The heating elements 130 are connected to an electrical power source 132 such as the one that is used to power the launcher device 100.

The tubular body 104 can be covered with an insulating material 134, such as polystyrene, to better maintain the heat in the balls 101 and minimize heat input needs for the heating elements 130.

A temperature sensor 136 can also be placed within the tubular body 104 so that the ball temperature can be monitored. That way, the user can set a specified temperature, and the heating system can maintain the balls 101 at the set temperature automatically by adjusting the power to the heating elements 130 as needed.

The tube 104 can also be used with other ball launching machines other than the machine disclosed herein.

The heated ball collecting tube 104 advantageously allows the ball launching machine 100 to be made lighter and simpler since no means for heating the balls is required due to the balls being heated prior to introduction of the ball into the launching chamber.

Figure 8:
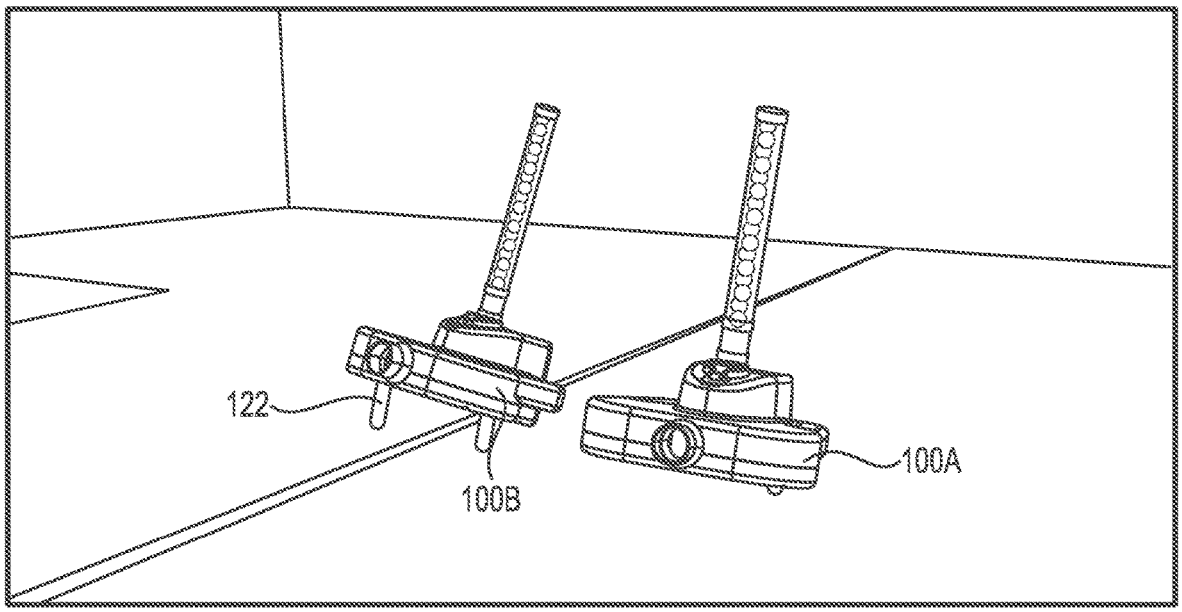
FIG. 8 is a perspective view of a squash court showing various example deployment configurations for an automatic ball launching system in accordance with an embodiment of the invention.
Figure 9:
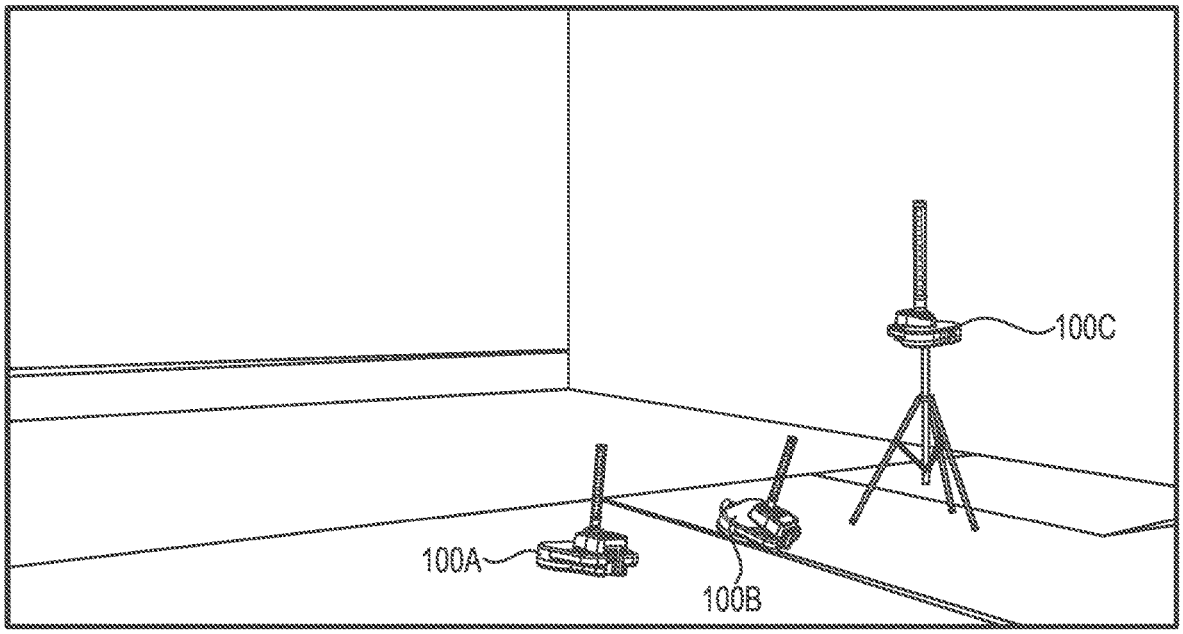
FIG. 9 is another perspective view of a squash court showing various example deployment configurations for an automatic ball launching system in accordance with an embodiment of the invention.

Referring to FIGS. 8-9, a plurality of feet 122 extend below the base unit 102 to provide for stability. The feet 122 are located adjacent to the front side of the base unit and can be adjusted up and down (into and out of the base unit 102) so that the angle of launch of a ball with respect to the horizon can be adjusted to be any desired angle setting achievable via the range of travel of the feet 122.

In FIG. 8, the launching machine 100A is set in a low trajectory setting so that the ball will be launched at a small angle relative to the horizon or the floor of the squash court. In contrast, machine 100B is set at a much larger angle of launch because the front feet 122 are greatly extended as compared to machine 100A.

The launching machine 100C in FIG. 9 shows a further option where the device is mounted atop a tripod 106 at a raised vertical height to simulate an attacking shot.

In FIG. 9, both machines 100A and 100B are again shown. Machine 100C is mounted atop a tripod 106 for added elevation but with a smaller launch angle than machine 1006. These variations and the ability to change the ball launch speed provide for a wide variety of launch characteristics to be selected by the user.

The automatic ball feeding apparatus 100 and launching system disclosed herein is advantageous for being light, portable and powerful. The tube 104 used as a collector provides for quick collection of balls 101. The launcher device 100 can be adjusted to feed high-to-low and feed while located in front of the player.

In yet another aspect, multiple ball launchers can be used together simultaneously in a variety of configurations, such as shown in FIG. 8 or FIG. 9, in order to create shot patterns that would not be possible with a single machine. For example, shots can be created from low launch point to correspond generally with a defensive shot. Raising the launch height allows a range of attacking (high to low) shots to be simulated.

In a further use case, balls can be precisely launched one at a time by the launching apparatus 100. This simulates a typical coaching/training scenario where a coach/player A feeds a ball and player B executes a desired shot in return. This provides for greater accuracy and control, particularly for difficult-to-execute feeds—such as, for example, simulated serves to player B's backhand—and feeding drills that incorporate movement on the part of the player.

Figure 10:
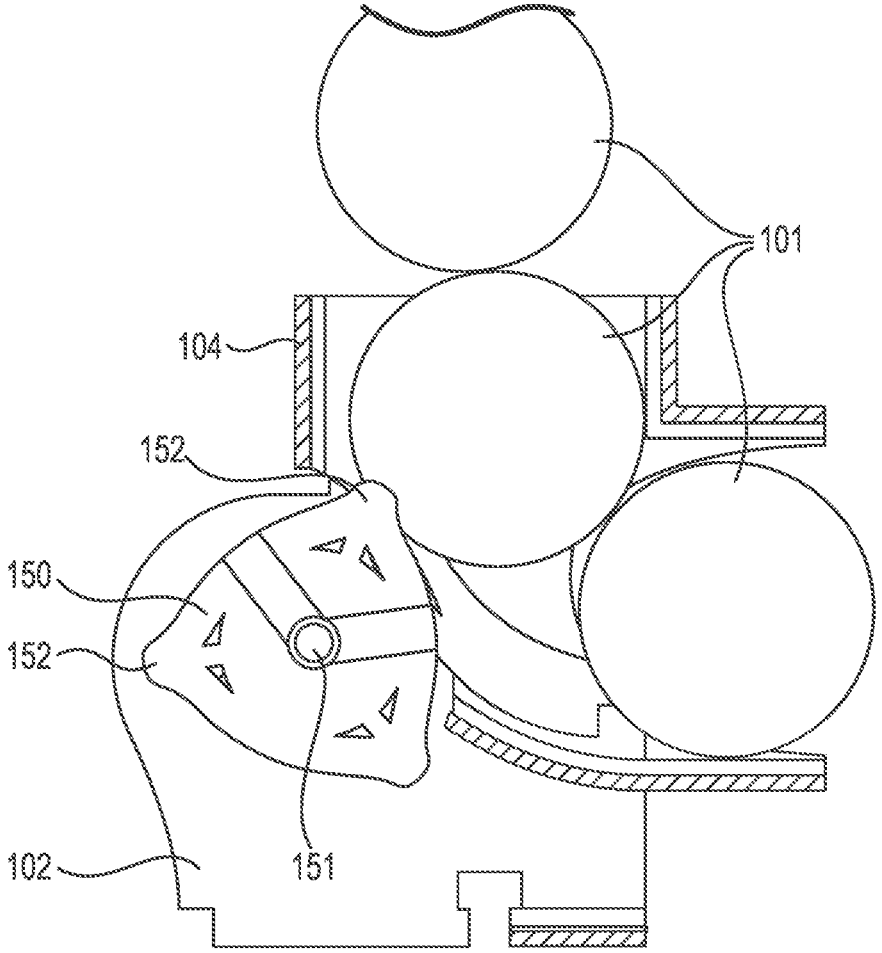
FIG. 10 is a side cross-sectional view of a feed control mechanism for an automatic ball launching system in accordance with an embodiment of the invention.

Referring to FIG. 10, the ball metering means comprises a feed control mechanism for the balls 101. The balls 101 staged in the feed tube 104 encounter a meter wheel 150 that employs radially-spaced ribs 152 to block the passage of the balls to the flywheels 114 of the launcher device 100. The meter wheel 150 is rotationally mounted so that a drive or feed motor 151 coupled to the wheel 150 can selectively rotate the meter wheel 150 to permit a single ball to pass to the flywheels 114 and be launched. Movement of the meter wheel 150 is stopped when a ball passes so that a second ball does not inadvertently also pass with the first ball and jam the launcher device 100.

The rotational frequency of the meter wheel 150 can be adjusted by its drive motor 151 so that the frequency of balls being launched can be selectively adjusted or controlled. The launcher device 100 can be set or programmed for a given periodicity of automatic ball launches, or the launcher device 100 can be operated in a launch on-demand manual mode by the user.

The meter wheel 150 is shown as having three ribs 152 radially spaced about 120 degrees apart. More ribs can be provided depending on the diameter of the wheel 150 and the diameter of the balls being metered. However it is preferred that the ribs be equally spaced radially around the meter wheel 150 for consistency of metering. The ribs can have a rectangular profile when viewed from their circumferential side. Alternatively the ribs can have a non-rectangular profile when viewed from their circumferential side. For example, the ribs can have a raised center portion or hump that is taller in profile than the portions to each side of the raised portion.

Figure 11:
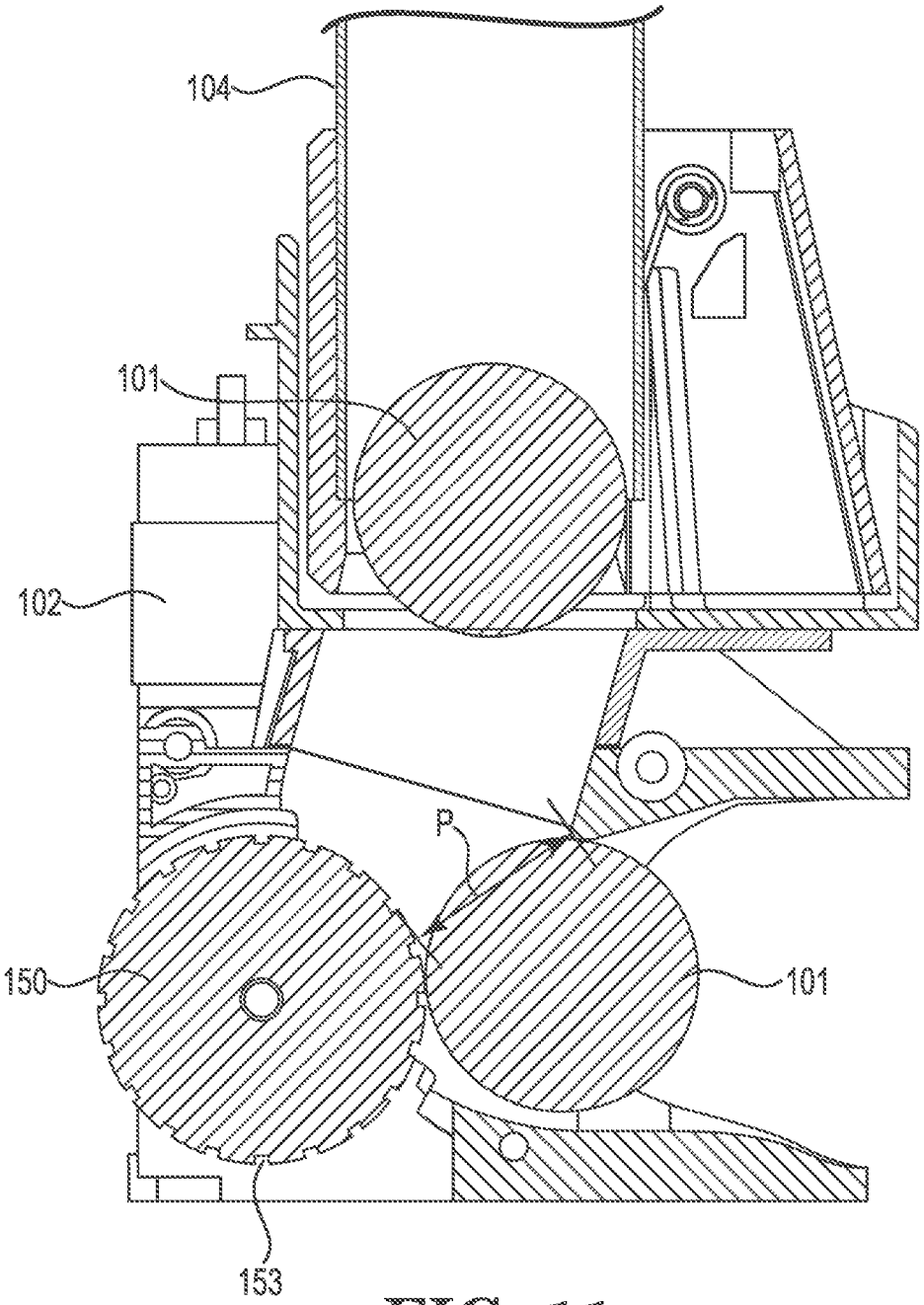
FIG. 11 is another side cross-sectional view of a feed control mechanism for an automatic ball launching system in accordance with an embodiment of the invention.

FIG. 11 shows an alternative embodiment where the meter wheel 150 has no ribs. The meter wheel instead has a textured circumferential outer surface that comprises a plurality of radially-spaced relief grooves 153 or channels to offer frictional contact with the balls 101. There is a pinch-point P defined between the outer circumference of the wheel 150 and the opposing structure of the ball path that defines a slightly smaller dimension than the ball's diameter. This pinch point P prevents the ball 101 from passing until the wheel 150 rotates sufficiently to pass the ball through the pinch point P.

In order to achieve consistent and reliable operation of the launcher, the onboard electronic controller (e.g. processor and associated memory) can determine when a given ball has been metered or passed to the flywheels for launching. Such determination allows the controller to launch balls with the desired frequency.

In one embodiment, rotation of the meter wheel 150 can be detected by the controller by putting an encoder on the shaft of the meter wheel 150 in order to provide positional feedback to the controller. However, this adds mechanical complexity and can be detrimental to reliability and cost.

In another embodiment, a stepper motor can be used to selectively drive the meter wheel 150. However, a stepper motor with adequate torque requires a large drive current that would quickly deplete any reasonably-sized onboard battery used to power the ball launcher.

The further alternative of using a brushed direct-current motor is inexpensive, efficient and reliable, but does not itself provide any position data. Thus, an additional aspect of certain embodiments of the invention includes a novel methodology of determining when a ball is metered based upon monitoring the DC motor current.

The ribs 152 or grooves 153 of the meter wheel 150 compress the squash ball when pushing the ball 101 past the pinch point towards the flywheels 114. This pushing the ball 101 past the pinch point creates an increased load on the brushed DC motor 151 used to turn the feeder wheel 150. This load increase causes a corresponding rise in the current being consumed by the DC motor. The controller can be programmed to determine the load on the motor by monitoring the motor current and using the current value to detect the passing of a squash ball through the pinch point as noted above. The DC motor can then be stopped by the controller that is operably coupled to the motor once the ball has passed the pinch point.

Figure 12:
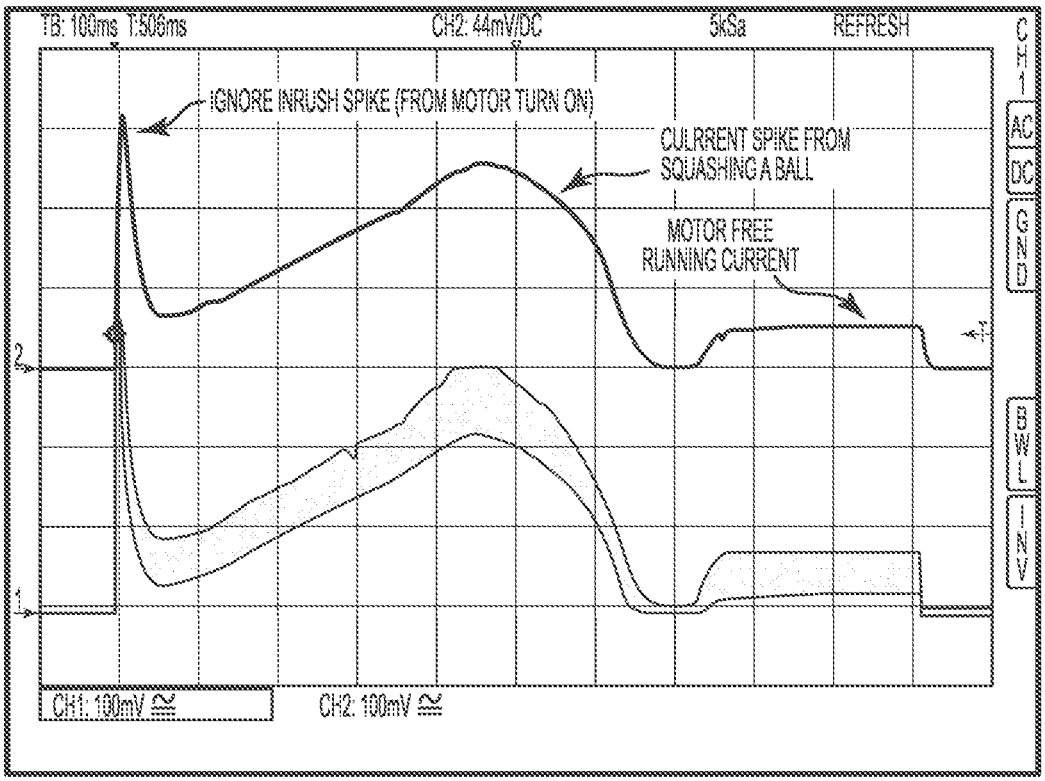
FIG. 12 is a graph of a meter wheel motor current versus time for an automatic ball launching system in accordance with an embodiment of the invention.

FIG. 12 illustrates a graph of the current of a geared DC motor 151 driving the meter wheel 150 over a period of time. The motor's current is shown through one cycle of the ball passing through the meter wheel 150 to the fly wheels 114 so that it can be launched. The lower line is the actual plotted current without any filtering. Since the current profile of the motor is inherently noisy (electrically), a cleaned-up output using a low pass filter is also provided on the graph as the uppermost plat line. The graph clearly shows a rise in the current value prior to the ball being introduced to the flywheels, followed by a drop in current following the ball being metered by the flywheels.

The transition from the current value at peak compression of the squash ball to the current trough value after the ball has exited the meter wheel is indicative of a meter-event and can be defined as the optimum time to stop the meter wheel's motor. If the motor 151 is stopped at the point where the trough initially occurs (or immediately thereafter), this will prevent any subsequent balls from being wedged in the meter wheel 150 or flywheel 114 mechanisms and will minimize the risk of a jam or a double ball firing event. After a lapse of a set period of time, or upon a prompt from the user, the controller re-starts the drive motor to turn the meter wheel to pass another ball to the flywheels 114.

In a further alternative, the processor also monitors the current or the rotational speed (RPM) of the motors employed to spin the flywheel mechanisms 114 in order to determine that a launch event has occurred. A current spike, or drop in RPM, will occur upon the launch of a ball by the flywheels 114. Thus, the controller can be programmed to determine if a ball is launched by the flywheels within a preset time window following a the passage of a ball past the meter wheel 150 as described above. For example, failure to detect a launch of the ball via the flywheels within a half-second window following the trough value of the current of the drive motor 151 of the meter wheel 150 could be determined to be a misfire or jam condition, and the launching machine 100 will shut down or take other action as programmed.

In another alternative, an optical sensor can be employed to detect the presence of a ball at the inlet to the flywheels. If a ball dwells for more than a preset time period (e.g. one second) in the inlet, then the controller that is coupled to the optical sensor can conclude that a fault has occurred such as a jam or misfire.

In yet another alternative, a mechanical actuator can be provided to forcibly push each ball into the inlet of the flywheels.

In use, software code programmed into the controller's memory and executed by the controller can enable the launcher to monitor the motor (which is electrically coupled to and controlled by the controller) for the characteristic current increase (hump or peak) followed by the current drop (trough) discussed above and stop the meter wheel's motor at that time. Minimum current deltas for the hump to trough magnitude values can be set in the controller's programming to correspond to the particular type of balls and meter wheel configurations employed. The controller can also monitor the current draw of the motors driving the flywheels, the optical sensor and/or the mechanical actuator discussed above.

In yet another aspect of certain embodiments, the user can be provided with the ability to remotely control certain operational characteristics of the ball launcher device. This can be implemented by providing the user with means to alter programmable settings of the controller (e.g. via remote control or direct input to the launcher device 100). These programmable settings may include any one or more of the following:

- Control power: on/off
- Control firing mode: auto (continuous)/manual (or remote operated)
- Control ball firing interval in auto mode (e.g. between ~1 and 10 seconds)
- Control flywheel speed according to target exit velocity (e.g. between ~50 and 150 kph)
- Select reverse feeder drive in order to remove any jammed balls
- Illuminate LEDs to provide indication of ball launch
- Sound a buzzer to provide audible indication of ball launch event
- Option to disable the ball launch buzzer (or adjust volume thereof)

Figure 13:
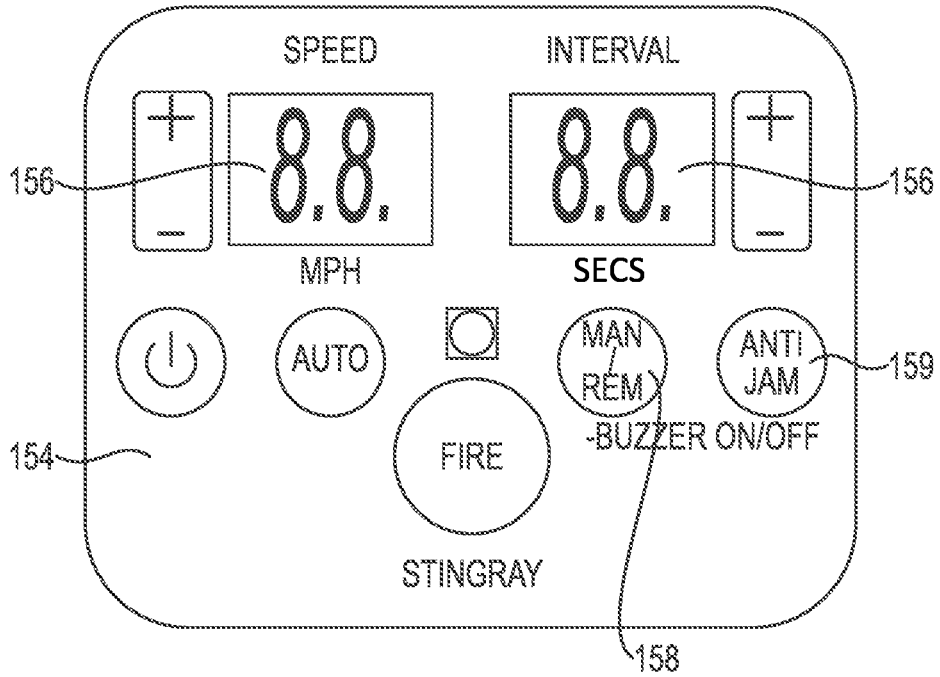
FIG. 13 is a front view of a remote control for an automatic ball launching system in accordance with an embodiment of the invention.

FIG. 13 shows an example of the interface of a hand-held user remote control unit 154 button and display layout. The remote control unit 154 can wirelessly communicate with the ball launcher via any conventional wireless communication means, such as Bluetooth, etc.

The remote control unit 154 includes seven-segment visual displays 156 to provide feedback on programmed speed and ball firing interval. Displaying the speed in MPH means the speed will fit on two digits, not three, and is also the primary unit in the US market. Since the buzzer on/off control is rarely used, it is activated/deactivated by a button combination such as holding down the "Man/Rem" button 158 and the "Anti Jam" button 159 at the same time. The various buttons provided to the remote 154 are preferably membrane buttons since they are reliable, robust and moisture resistant.

Figure 14:
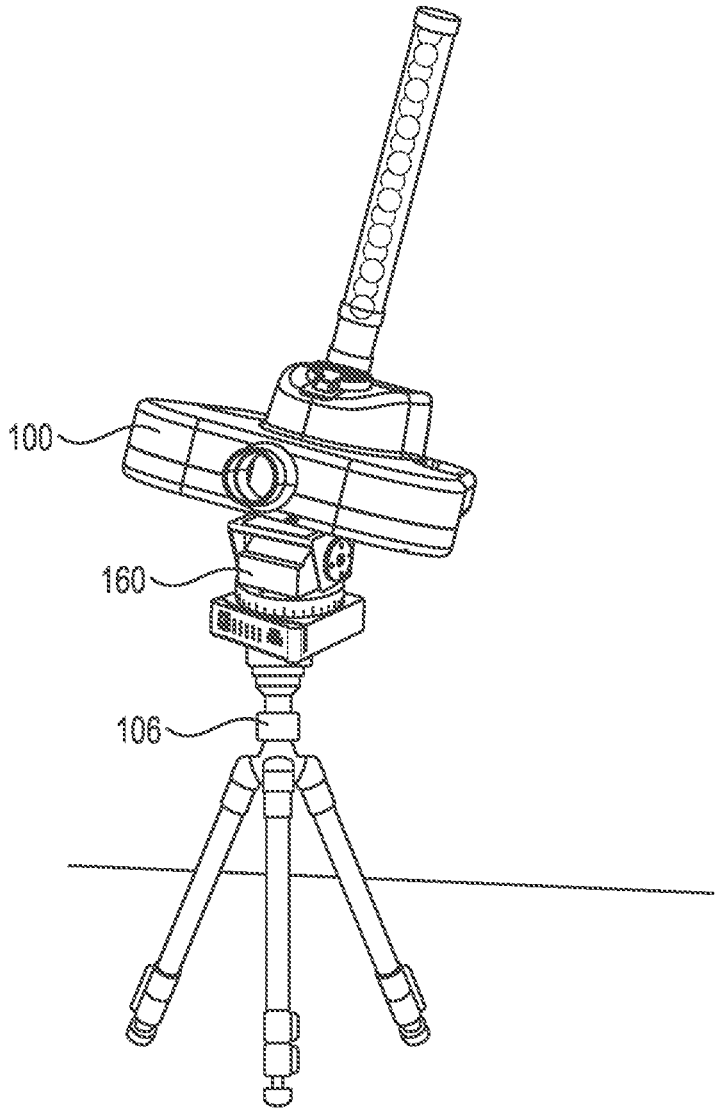
FIG. 14 is another perspective view of an automatic ball launching system in accordance with an embodiment of the invention.
Figure 15:
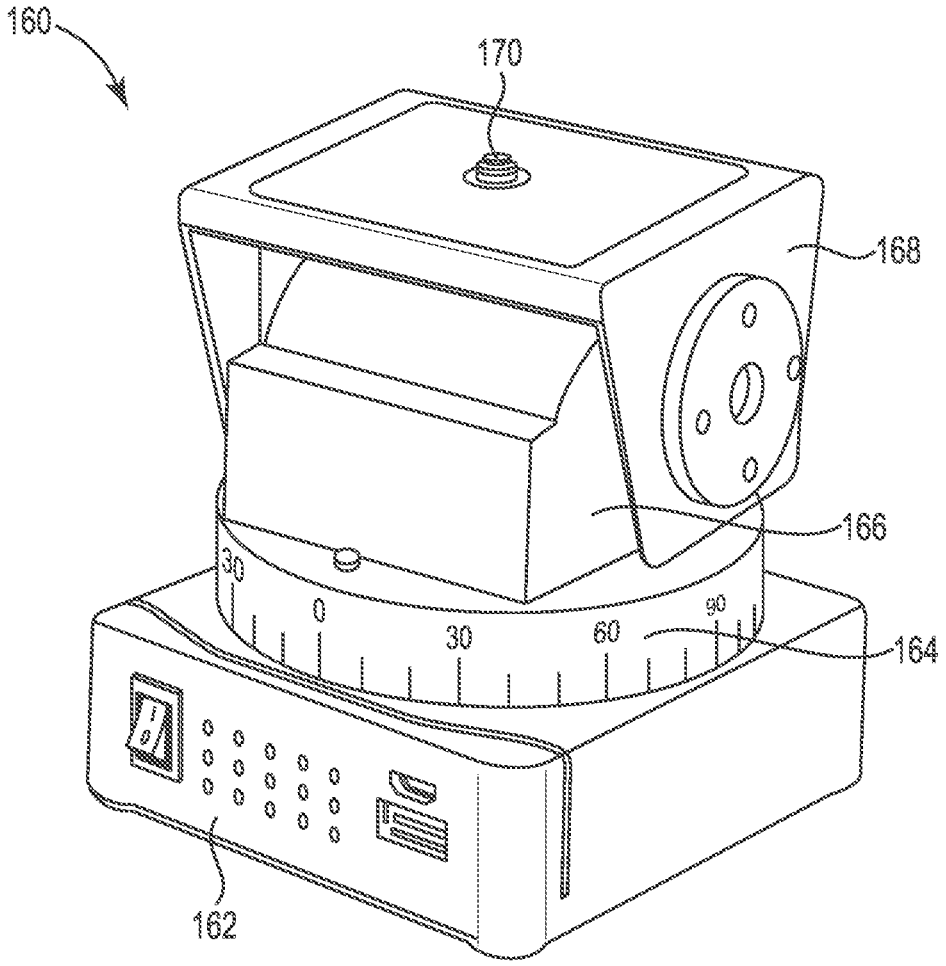
FIG. 15 is a perspective view of a multi-directional head for an automatic ball launching system in accordance with an embodiment of the invention.

Referring to FIGS. 14-15, the automatic ball launcher 100 can be secured atop a multi-directional and motorized head 160. The multi-directional and motorized head 160 can set atop the ground or it can be secured atop a tripod 106. The multi-directional and motorized head 160 enables the elevation and azimuth of the ball launcher to be changed automatically via actuation of a respective elevation motor or azimuth motor, or both, that are disposed within the multi-directional and motorized head 160. The actuation of these motors can be according to an automatically-executing program or as remote controlled by the user.

The multi-directional and motorized head 160 comprises a base housing 162 in which the azimuth motor and the electronics for controlling the motors are housed. The motors can also be controlled by the controller of the launching device 100 if the controller is electrically connected to the motors.

Atop the base 162 is a turntable 164 that rotates to change the azimuth orientation of the ball launcher 100. The azimuth motor inside of the base 162 is coupled to the turntable 164 to impart the rotational motion.

An elevation housing 166 is secured atop the turntable 164. The elevation motor is disposed inside of the elevation housing 166. An elevation bracket 168 is pivotally coupled to the elevation housing 166 so that the elevation orientation of the ball launcher 100 can be changed by the elevation motor. The elevation motor is coupled to the elevation bracket 168 via an internal shaft or by being geared to the axle of the elevation bracket that extends into the elevation housing 166.

A threaded mount 170 is provided atop the elevation bracket 168 for mounting the ball launcher 100 to the multi-directional and motorized head 160. Other mounting means can be provided alternatively or in addition thereto, such as for example, one or more mounting apertures through the mounting bracket and mechanical fasteners.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A ball launching machine, comprising:

a base unit comprising an enclosure;

a pair of counter-rotating flywheels disposed within the enclosure;

a meter wheel disposed within the enclosure, the meter wheel located adjacent to an inlet to the pair of counter-rotating flywheels such that the meter wheel can selectively pass the balls to the pair of counter-rotating flywheels via rotation of the meter wheel;

a drive motor coupled to the meter wheel; and a controller electrically coupled to the drive motor, wherein the controller is configured to selectively actuate the drive motor to turn the meter wheel, and wherein the controller is configured to determine that one of the balls has been metered by monitoring a load value of the drive motor.

2. The ball launching machine of claim 1, wherein a rotational axis of the meter wheel is oriented perpendicular to a rotational axis of the pair of counter-rotating flywheels.

3. The ball launching machine of claim 1, wherein the meter wheel comprises a textured circumferential outer surface.

4. The ball launching machine of claim 1, further comprising a feed tube coupled to the base unit, wherein the feed tube comprises an elongated tubular body with an open top end covered by a removable cap and an open bottom end configured to be securely inserted into a top opening defined in the enclosure.

5. The ball launching machine of claim 4, wherein the feed tube comprises a heating element.

6. The ball launching machine of claim 5, wherein the feed tube further comprises a temperature sensor disposed within the feed tube.

7. The ball launching machine of claim 4, wherein the feed tube further comprises a solenoid provided to the open bottom end to prevent balls from prematurely exiting through the bottom end.

8. The ball launching machine of claim 5, wherein the heating element is embedded in a sidewall of the feed tube.

9. The ball launching machine of claim 1, further comprising a plurality of adjustable front feet provided to the enclosure that extend vertically downwards from a bottom surface of the enclosure.

10. The automatic ball launcher of claim 1, further comprising a vertically extending stand or tripod secured to the enclosure so that the base unit is maintained in an elevated position.

11. The ball launching machine of claim 1, wherein the controller is configured to determine that one of the balls has been metered when a current being monitored for the drive motor drops to a trough following a rise to a peak value by a pre-set magnitude value.

12. The ball launching machine of claim 11, wherein the controller is configured to stop the drive motor from rotating the meter wheel following the determination that one of the balls has been metered.

13. The ball launching machine of claim 1, further comprising a multi-directional and motorized head coupled to the base unit, the multi-directional and motorized head comprising an elevation motor configured to automatically adjust an elevation of the base unit and an azimuth motor configured to adjust an azimuth orientation of the base unit.

14. The ball launching machine of claim 1, further comprising a wireless remote control for the ball launching machine, the wireless remote control comprising a first visual display indicating a speed setting for launching of the balls and a second visual display indicating a time interval for launching the balls.

15. The ball launching machine of claim 1, wherein the controller is further configured to determine that a ball launch event has occurred by monitoring a rotational speed of at least one of the pair of counter-rotating flywheels.

16. Method of staging balls to be launched with an automatic ball launching device, the method comprising:

providing a metering wheel to stage balls to be launched by a pair of counter-rotating flywheels;

monitoring a current of a drive motor coupled to the metering wheel; and determining by the automatic ball launching device that one of the balls has been metered when the current of the drive motor drops to a trough by a pre-set magnitude following a rise to a peak value.

17. The method of claim 16, further comprising stopping the drive motor from rotating the meter wheel following the determination that one of the balls has been metered.

18. The method of claim 16, further comprising determining that a ball launch event has occurred by monitoring a rotational speed of at least one of the pair of counter-rotating flywheels.

19. A ball feed control system for an automatic ball launching device, the system comprising:

a drive motor;

a meter wheel coupled to the drive motor, the meter wheel located adjacent to an inlet to a pair of counter-rotating flywheels such that the meter wheel can selectively pass the balls to the pair of counter-rotating flywheels via rotation of the meter wheel;

and a controller electrically coupled to the drive motor, wherein the controller is configured to selectively actuate the drive motor to turn the meter wheel, and wherein the controller is configured to determine that a ball launch event has occurred by monitoring a rotational speed of at least one of the pair of counter-rotating flywheels.

20. The ball feed control system of claim 19, wherein the controller is configured to determine that a ball has been metered to the counter-rotating flywheels when a current being monitored for the drive motor drops to a trough following a rise to a peak value by a pre-set magnitude value, and wherein the controller is configured to stop the drive motor from rotating the meter wheel following the determination that one of the balls has been metered.

* * * * *